US005887660A

United States Patent [19]

Yokley et al.

[11] Patent Number: 5,887,660

[45] Date of Patent: Mar. 30, 1999

[54] LINER PACKER ASSEMBLY AND METHOD

[75] Inventors: John M. Yokley, Kingwood; Mark J. Murray, Sugar Land, both of Tex.; Ronald J. Selby, Harvey; Robert Richard Olman, Washington, both of La.

[73] Assignee: Smith International, Inc, Houston, Tex.

[21] Appl. No.: 782,416

[22] Filed: Jan. 14, 1997

Related U.S. Application Data

[60] Provisional application No. 60/012,669 Mar. 1, 1996.

[51] Int. Cl.[6] ..... E21B 33/12; E21B 34/14

[52] U.S. Cl. ..... 166/386; 166/142; 166/185

[58] Field of Search ..... 166/142, 143, 166/152, 180, 185, 196, 386, 387

[56] References Cited

U.S. PATENT DOCUMENTS

| | | | |
|---|---|---|---|
| 4,334,582 | 6/1982 | Baker et al. | 166/355 |
| 4,657,082 | 4/1987 | Ringgenberg | 166/386 X |
| 4,917,191 | 4/1990 | Hopmann et al. | 166/386 X |
| 4,928,772 | 5/1990 | Hopmann | 166/386 |

FOREIGN PATENT DOCUMENTS

| | | |
|---|---|---|
| 1077562 | 8/1967 | United Kingdom . |
| 2056530 | 3/1981 | United Kingdom . |

*Primary Examiner*—David J. Bagnell
*Attorney, Agent, or Firm*—Conley,Rose & Tayon, P.C.

[57] ABSTRACT

The liner packer assembly and method includes a liner packer having a tubular body with an aperture for the flow of wellbore fluids. A packing element is movably disposed on the tubular body between an open position on one side of the aperture for allowing wellbore fluids to flow through the aperture to a closed position on the other side of the aperture for closing flow through the aperture and for packing off the annulus between the packer and outer casing. During the cementing operation, drilling fluids and cement are allowed to flow through the annular area formed by the packer and outer casing and also flow through the aperture in the tubular body of the packer and up the inside diameter or inner annular area formed by the packer and inner tubular string. The inner and outer annular areas around packer approximately the flow area below the packer between the inner tubular string and the outer casing.

19 Claims, 8 Drawing Sheets

LINER PACKER ASSEMBLY AND METHOD

CROSS-REFERENCE TO RELATED APPLICATION

This is an application claiming the benefit of U.S. Provisional Application Ser. No. 60/012,669 filed Mar. 1, 1996 and entitled Liner Assembly and Method.

BACKGROUND OF THE INVENTION

The present invention relates to a method and apparatus for cementing and packing off a liner within a well, and more particularly to a one trip liner packer, and still more particularly to a liner packer for packing off a liner within the well.

Typically, in the drilling of a well, a borehole is drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. Generally, this is repeated until a plurality of concentric casings are suspended and cemented within the well to a depth which causes the well to extend through one or more hydrocarbon producing formations.

Oftentimes, rather than suspending a concentric casing from the bottom of the borehole to the surface, a liner is suspended either adjacent the lower end of a previously suspended and cemented casing or from a previously suspended and cemented liner. The liner extends from the previously set casing or liner to the bottom of the new borehole. A liner is casing which is not run to the surface. A liner hanger is used to suspend the liner within the lower end of the previously set casing or liner. Typically, the liner hanger has the ability to receive a tie back tool for connecting the liner with a string of casing which extends from the liner hanger back to the surface. Liners may be used for both land and offshore wells.

A setting tool disposed on the lower end of a work string is releasably connected to the liner hanger which is attached to the top of the liner. The work string lowers the liner hanger and liner into the open borehole extending below the lower end of the previously set casing or liner. The borehole is filled with fluids such as drilling mud which flows around the liner and liner hanger as the liner is run into the borehole. The assembly is run into the well until the liner hanger is adjacent the lower end of the previously set casing or liner and the lower end of the liner is above the bottom of the open borehole. As can be appreciated, it is desirable to have the inside diameter of the liner be as large as possible to allow more space for additional liners to be disposed within the well.

When the liner reaches the desired location relative to the bottom of the open borehole and the previously set casing or liner, the setting tool is actuated to move slips on the liner hanger from a retracted position to an expanded position and into engagement with the previously set casing or liner. Thereafter, when weight is applied to the hanger slips, the slips are set to support the liner.

The liner hanger setting tool may be actuated either hydraulically or mechanically. See U.S. Pat. No. 4,712,614. The setting tool can have a hydraulically operated setting mechanism for the hanger slips or can have a mechanically operated setting mechanism for the setting slips. A hydraulically operated setting mechanism typically employs a hydraulic cylinder which is actuated by pressure in the bore of the work string. In mechanically setting the liner hanger, it is usually necessary to obtain a relative downhole rotation of parts between the setting tool and liner hanger to release the hanger slips. The hanger slips are then one-way acting in that the hanger and liner can be raised or lifted upwardly but a downward motion of the liner sets the slips to support the hanger and liner within the well.

Then to release the hanger, the setting tool is lowered with respect to the liner hanger and rotated to release a running nut on the setting tool from the liner hanger. Cement is then pumped down the flowbore of the work string and liner and up the annulus formed by the liner and open borehole. Before the cement sets, the liner hanger setting tool and work string are removed from the borehole. In the event of a bad cement job, a liner packer and liner packer setting tool are then attached to the work string and lowered back into the borehole. The packer is set utilizing the liner packer setting tool.

Packers for liners are often called liner isolation packers. A typical liner top isolation packer system includes a packer element mounted on a mandrel. A seal nipple is disposed below the mandrel which stings into a tie back receptacle on top of or below the liner hanger. A liner isolation packer is used to seal the liner in the event of a bad cement job. Typically, the liner isolation packer is set down on top of the hanger and the packer is set by a setting tool to form a seal of the annulus between the liner and the previously set casing or liner.

Generally, the deeper a well is drilled, the higher the temperature and pressure which is encountered. Thus, it is desirable to have liners with liner packers which will ensure quality cementing of the liner so as to provide a high safety factor in preventing gas from the formation from migrating up the annulus between the liner and outer casing.

During the cementing operation, drilling mud or fluid in the annulus between the liner and outer casing is displaced by cement as the cement is pumped down the flowbore of the work string. First the drilling mud and then the cement flows around the lower end of the liner and up the annulus. If there is a restriction to flow in the annulus, the flow of the cement slows and a good cementing is not achieved. Any slowing of the cementing in the annulus allows time for the gas in the formation to migrate up the annulus and through the cement to prevent a good cementing job.

Prior art liner top packers restrict the bypass in the annulus at the point of the liner packer. The diameter of the liner packer is just below the drift of the outer casing that the liner is being run through. The increased diameter allows for sufficient back-up for the liner packer to seal properly. However, this also restricts the bypass flow area around the packer causing higher fluid velocities and lower pressures that will either fluid cut the packing element or swab it off entirely. The reduced bypass area also tends to be a stopping location for any solids that may be washed up the well. These solids can packoff at the liner so as to set the liner packer prematurely.

In the cementing operation, the drilling mud is first pumped through the well at a high rate of speed to "clean the well" of any deleterious material. If there is a restriction at the liner packer, the fluid flow may cause the liner packer to set prematurely. If the liner packer sets prematurely, it seals the annulus to fluid flow and the cement can no longer be pumped down hole.

Conventionally, the liner packer has all of its setting mechanism disposed on a mandrel that is located on the outside diameter of the liner, i.e. is located in the annulus formed by the liner and outer casing. The by-pass area around the liner packer for the cement, is formed by the annulus or annular space between the outer casing and liner. Thus, locating the setting mechanism for the liner packer on the outside of the mandrel limits and restricts the annular space for allowing the cement to by-pass the liner packer. Once the by-pass area is set, only a certain volume of drilling mud and cement is allowed to pass around the liner packer at any given time. If the flow rate of the drilling mud and cement is such that the drilling mud and cement cannot bypass the liner packer fast enough, the liner packer becomes a restriction to flow providing a back pressure on the drilling mud and cement.

As an example of the above, if a liner has a diameter of 11¾ inches and the outer casing has a diameter of 13⅜ inches, the annular space around the liner packer provides approximately 12.2 square inches of bypass. When the flow of cement encounters the liner packer, the bypass area is reduced to approximately one-half thereby causing the velocity of the fluid flow over the packoff elements of the packer to increase dramatically. This causes the fluid to cut the packing elements and may cause the packing elements to be eroded away. As the fluid flow over the packing elements increases, a low pressure area is created causing the packing elements to expand and get sucked up into the fluid flow. Further, as indicated above, this restriction to flow causes surge pressures downhole because the pumps at the surface are forcing fluids into a fluid filled annular column and the fluid flow is restricted at the liner packer causing the pressure to increase. If this pressure becomes great enough, the drilling fluids or cement may be forced into the formation causing formation damage.

Further, the packing elements of prior art liner packers have not been sufficiently rigid to allow the packing elements to stroke over a port in the packer mandrel since it is necessary for the prior art packing element to fit tightly around the mandrel to ensure sealing engagement. Thus, in prior art packers, any attempt to stroke the packing element over a port causes the edges of the port to tear or damage the interior sealing surface of the packing elements thus preventing them from attaining an adequate sealing engagement upon setting the liner packer.

The present invention overcomes the deficiencies of the prior art.

SUMMARY OF THE INVENTION

The liner packer assembly and method includes a liner packer having a tubular body with an aperture through the wall of the tubular body for the flow of wellbore fluids. A packing element is movably disposed on the tubular body between an open position on one side of the aperture for allowing wellbore fluids to flow through the aperture to a closed position on the other side of the aperture for closing flow through the aperture and for packing off the annulus between the packer and outer casing. An actuator member is mounted on the tubular body for moving the packing element from the open position to the closed position and against a stop member on the tubular body disposed below the aperture. As the actuator member compresses the packing element against the stop member, the packing element expands into sealing engagement with the outer casing. The actuator member includes a ratchet member which engages ratchet teeth on the outer surface of the tubular member so as to allow the packing element to move from the open position to the closed position but not from the closed position to the open position thus locking the packing element into the closed position and into sealing engagement with the outer casing. The distance between the aperture and the stop member is greater than the length of the packing element so that the packing element does not seal over the top of the aperture.

In operation, the liner packer is disposed between an inner tubular string and an outer casing. The inner tubular string includes a work string supporting a packer setting tool, packer, and a liner string. During the cementing operation, cement is pumped down on top of the drilling fluids in the well causing first the drilling fluids and then the cement to flow down the flow bore of the inner tubular string and then up the annulus formed between the inner tubular string and the outer casing. Upon first the drilling fluids and then cement reaching the packer, the fluids flow through the annular area between the packer and outer casing and also flow through the aperture in the wall of the tubular body of the packer and up the inside diameter or inner annular area between the packer and inner tubular string to avoid any restriction in flow past the liner packer. The inner and outer annular areas around the packer approximate the flow area below the packer between the inner tubular string and the outer casing.

One principal advantage of the liner packer of the present invention is that the liner packer allows an increase in the annular bypass area for the flow of cement during cementing operations. Thus, the liner packer of the present invention increases the bypass area allowing greater fluid flow and particularly avoiding a flow restriction.

The cross sections of the liner packer and the cross sections of the other metal members associated with the liner packer have also been reduced to increase the bypass area.

Other objects and advantages of the present invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
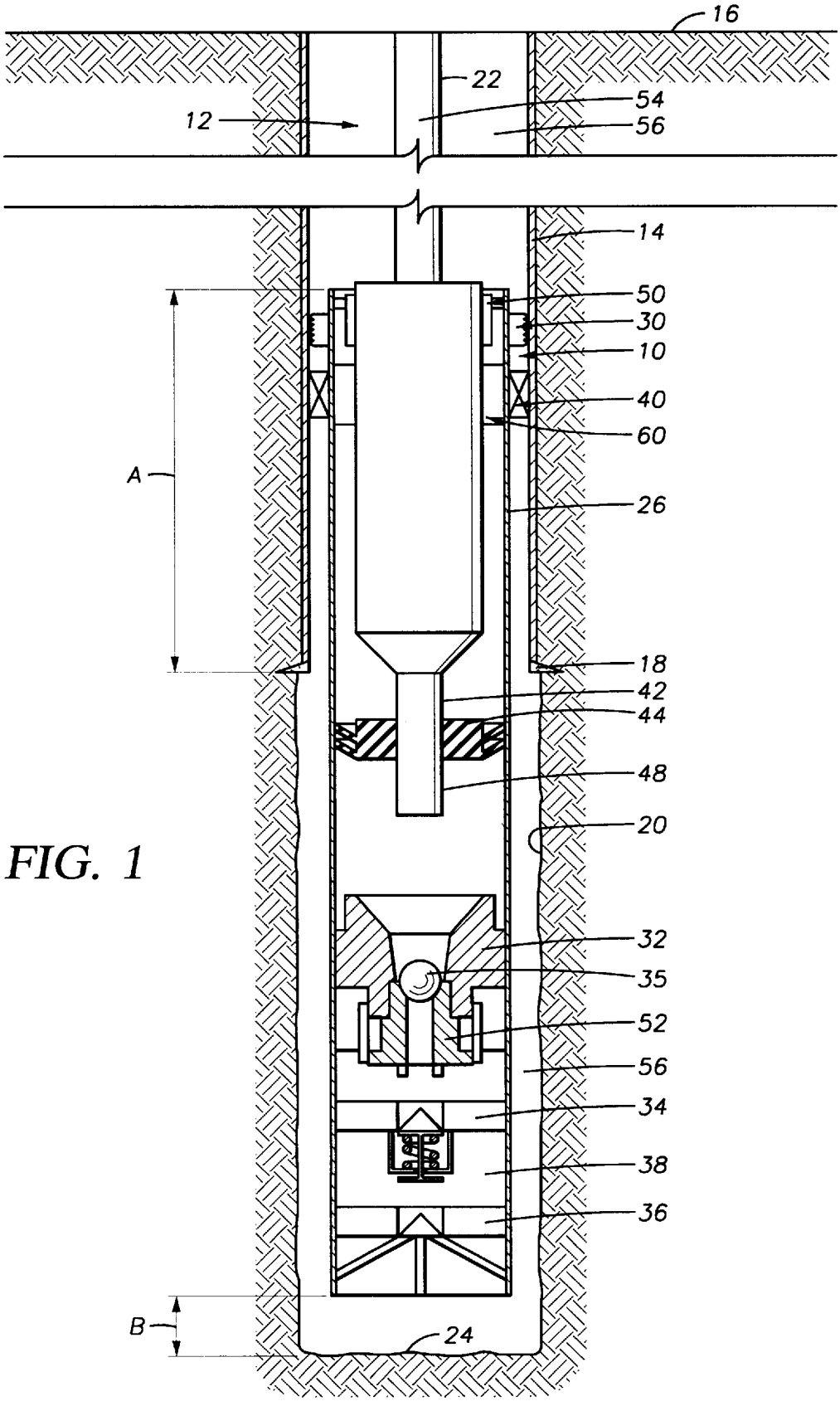
FIG. 1 is a diagram of a cross-sectional elevation view of a well in which is suspended the liner assembly of the present invention.

Referring initially to FIG. 1, the liner assembly 10 of the present invention is shown suspended within a well 12. The well 12 includes an outer casing 14 extending from the surface 16 down into the well 12 with its lower end cemented at 18. Outer casing 14 may be a previously set string of casing. After outer casing 14 has been cemented, the well is drilled deeper forming borehole 20. The liner assembly 10 is lowered through outer casing 14 and into borehole 20 by means of a work string 22. The top of the liner assembly 10 is suspended within the lower end of outer casing 14 so as to overlap outer casing 14. The lower end of liner assembly 10 is typically suspended off the bottom 24 of borehole 20.

The liner assembly 10 includes a liner hanger 30 and a packer 40 below which is suspended a pipe string forming the liner 26 for borehole 20. Mounted on the lower end of liner 26 is a landing collar 32, a float collar 34, and a shoe 36. Collar 34 and shoe 36 form a one-way valve which prevents the upward flow of fluids through liner 26. Disposed within liner 26, is a pocket slip setting tool 50 and a packer setting tool 60 below which extends one or more slick joints 42. Attached to the lower end 48 of slick joints 42 is a wiper member 44. The landing collar 32 provides a shear member 52 which receives a ball 35. Collar 32 also has a threaded receptacle to latch and lock wiper 44. The setting tools 50 and 60, liner 26 and work string 22, form a vertical flowbore 54 extending to the surface 16 for the passage of drilling fluids and cement. Likewise, liner 26 and work string 22 form an annulus 56 with borehole 20 and outer casing string 14 which extends to the surface 16. The annulus 56 extends from the surface 16 down to shoe 36 adjacent borehole bottom 24. Flowbore 54 and annulus 56 provide a flow path for drilling fluids and cement for the cementing operation to cement liner 26 within borehole 20, as hereinafter described in further detail.

Liner Packer

Referring now to FIGS. 2A–C and 5, liner packer 40 is disposed on liner assembly 10 (shown in FIG. 1) below liner hanger 30. Liner packer 40 includes a barrel or tubular member 62 having threads 64 at its upper end for threaded engagement with the lower end of pocket slip liner hanger 30. An inner annular latch groove 66 is provided adjacent the upper end of tubular member 62 and is adapted for receiving a plurality of latches 160 on packer setting tool 60, hereinafter described in detail. The upper portion of tubular member 62 has a reduced outer diameter 63. A plurality of arcuate members 72 are provided around the circumference of tubular member 62 at the change in diameter of member 62 to form a plurality of upwardly facing shoulders 68. Bypass slots 70 are provided between arcuate members 72 for the passage of well fluids and cement, as hereinafter described in further detail. Above and adjacent to shoulders 68 are a plurality of cement bypass ports 80 for the passage of well fluids and cement as hereinafter described in further detail. Above bypass ports 80 is disposed a pack off or packing element 90 and upper and lower compression rings 92, 94, respectively, which are positioned around a seal bore 74 on reduced diameter 63. One preferred packing element 90 is the ABC Packing Element manufactured by CDI Seals Incorporated. Above the upper compression ring 94 is a spacer ring 99 and a ratchet ring 96. Ratchet ring 96 has inwardly extending annular ratchet teeth 95 which are in engagement with ratchet teeth 76 around the outer circumference of tubular member 62 above bypass ports 80. A spacer and retainer ring 98 is disposed between ratchet ring 96 and dogs 180. The teeth 95 of ratchet ring 96 and the ratchet teeth 76 on tubular member 62 allow ratchet ring 96 to move downwardly while preventing the upward movement of packing element 90. A plurality of longitudinally extending apertures 78 are azimuthally spaced around tubular member 62 for receiving retractable setting dogs 180 on packer setting tool 60, as hereinafter described in further detail. A retainer ring 98 is provided above ratchet ring 96 which is notched at 82 for dogs 180.

While running in and cementing, the drilling fluids and cement flow up that portion of annulus 56 below liner packer 40 which is formed between liner 26 and outer casing 14. The drilling fluids and cement are then allowed to flow through the outer annular area 56A formed by tubular member 62 and outer casing 14. Further, the bypass ports 80 below the packing element 90 allow wellbore fluids to pass through the body of the liner packer 40 and up through the inside diameter of liner packer 40 which forms an inner annular area 56B between packer setting tool 60 and liner packer 40. Finally the wellbore fluids flow out the top of the packer setting tool 60.

The inner annular area 56B and outer annular area 56A approximate the flow area through that portion of annulus 56 between liner 26 and casing 14 below liner packer 40. During the setting process for the liner packer 40, the packing element 90 moves over the bypass ports 80 and bottoms out against the shoulders 68 of the packer tubular member 62. The packing element 90 is then set for sealing annulus 56 between liner 26 and outer casing 14.

The liner packer 40 allows for no or only a slight reduction in flow as the wellbore fluids come up the annulus 56 and bypass the liner packer 40. The bypass through the inside diameter of liner packer 40 significantly reduces the flow over the pack off elements 90 thereby reducing the effects of fluid cutting or possible swabbing. Further, the solids in the wellbore fluids will pass through the bypass ports 80 and settle inside the liner 26.

Packer Setting Tool

Figure 2A:
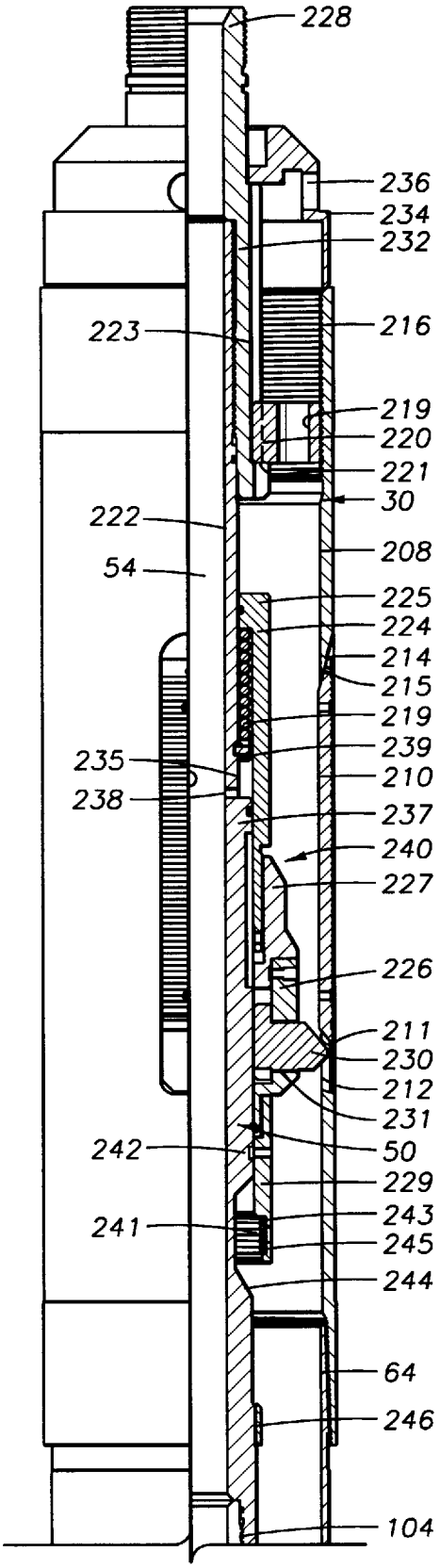
FIGS. 2A–C are a cross-sectional elevation view of the liner hanger, liner packer and the setting tools for the liner hanger and liner packer shown diagrammatically in FIG. 1.
Figure 2B:
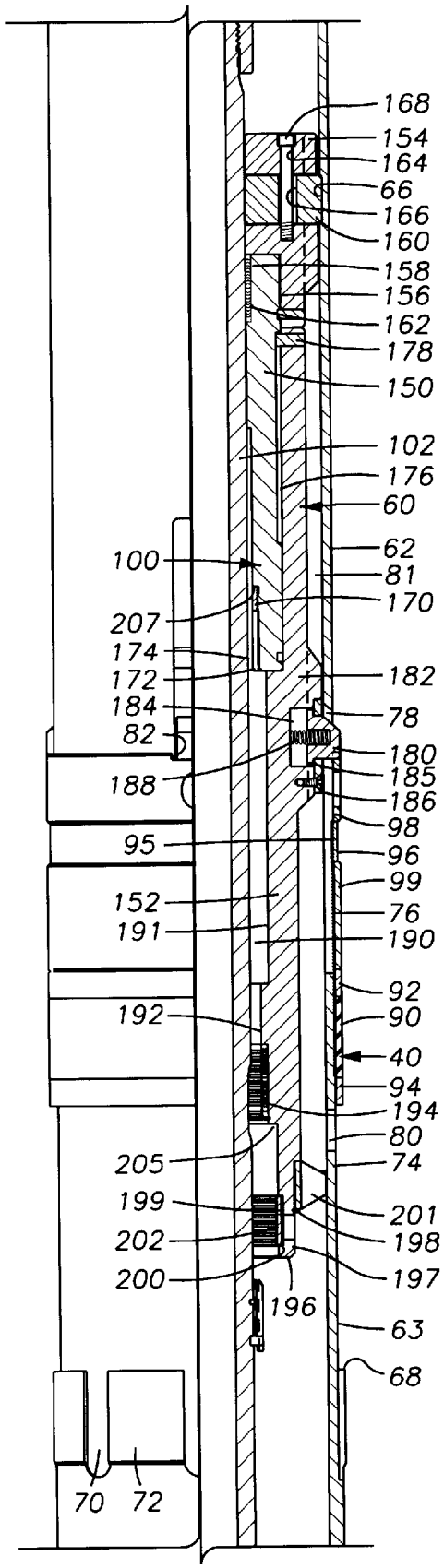
Figure 2C:
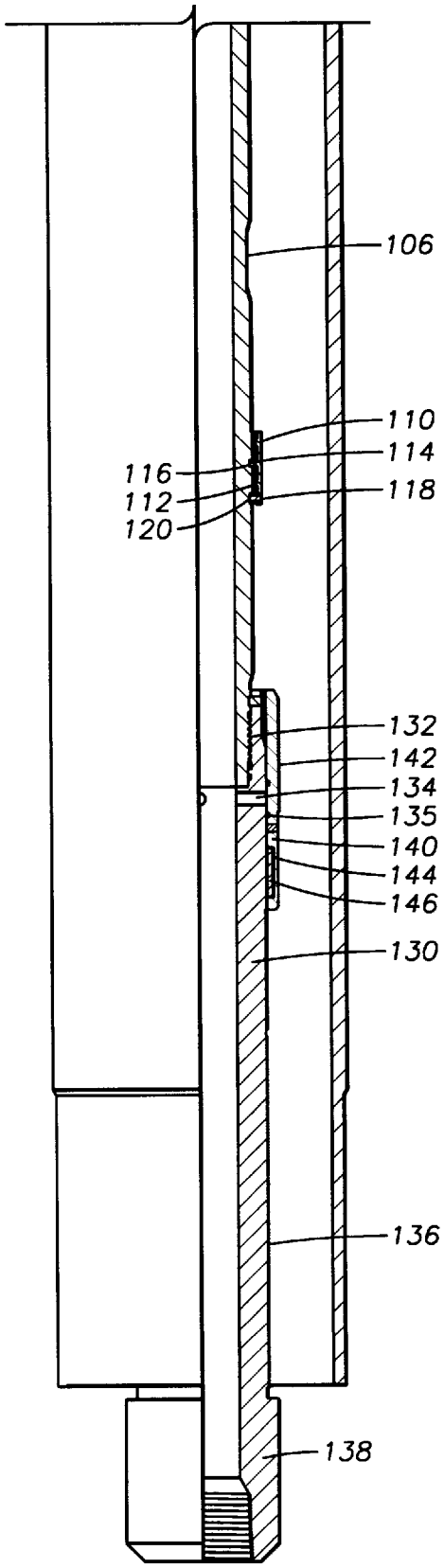
Figure 3:
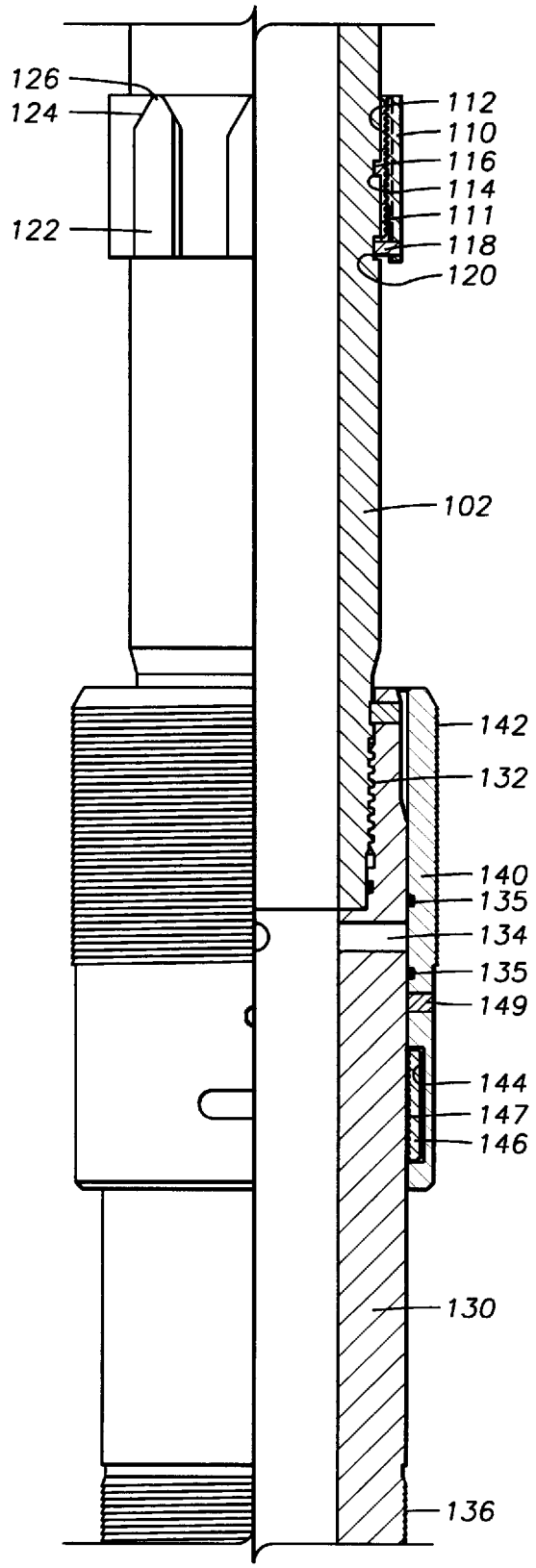
FIG. 3 is a cross-sectional elevation view of the release nut and ratchet sleeve on the lower end of the packer setting tool.

Referring now to FIGS. 2A, 2B, 2C and 3, packer setting tool 60 is shown disposed below pocket slip setting tool 50. Packer setting tool 60 includes a packer actuator and setting assembly 100 disposed around an inner mandrel 102 having threads 104 at its upper end for threaded engagement to the lower end of pocket slip setting tool 50. Packer setting tool mandrel 102 includes an outer annular dog release groove 106 disposed below packer setting assembly 100. A release nut 110 is mounted on mandrel 102 below release groove 106. Release nut 110 includes an inner threaded split ring 112 having outer threads which threadingly engage at 111 internal threads on release nut 110. Threaded split ring 112 includes an inwardly directed flange member 114 which is received within a notch 116 in mandrel 102 to prevent split ring 112 from rotating with respect to mandrel 102. The release nut 110 is also disposed on mandrel 102 by means of a shear screw 118 which extends into a blind hole 120 in mandrel 102. As best shown in FIG. 3, release nut 110 includes a plurality of longitudinally extending splines 122 disposed azimuthally around the outer circumference of release nut 110. The upper terminal end of splines 122 is beveled at 124 and 126 for guiding release nut 110 into spline nut 172, as hereinafter described in further detail.

A lower mandrel 130 is threaded at 132 to the lower end of inner mandrel 102. A port 134 extends through the wall of the upper end of lower mandrel 130 just below threads 132. Ratchet threads 136 are provided around the circumferential lower surface of lower mandrel 130. The terminal end 138 of lower mandrel 130 is connected to slick joints 42. A ratchet sleeve 140 is mounted around the upper end of lower mandrel 130. Annular sealing members 135, such as O-rings, are housed in grooves in sleeve 140 for initially sealing off port 134. Sleeve 140 includes external upper ratchet threads 142 adapted for engagement with split ratchet ring 200 of packer setting assembly 100, as hereinafter described in further detail. A drag pin 149 is provided in the wall of sleeve 140 for engaging the external surface of lower mandrel 130. Sleeve 140 includes a lower inwardly facing annular groove 144 in which is mounted a lower split ratchet ring 146 having internal ratchet teeth 147 adapted for engagement with ratchet threads 136 disposed therebelow on mandrel 130.

Referring now to FIG. 2B, packer setting apparatus 100 includes a body 150 and an actuator member or piston 152. Body 150 includes a latch retainer 154 threaded at 156 to its upper end. Retainer 154 and body 150 form an inner annular groove 158 for housing a packing seal 162 which sealingly engages the external surface of inner mandrel 102. Retainer 154 includes a plurality of apertures 164 housing retractable dogs or latches 160 which are received within latch groove 66 for supporting packer setting apparatus 100 on hanger setting tool 50. Latches 160 include a longitudinal bore 166 adapted for receiving threaded guide pins 168 for attaching latches 160 to retainer 154 while allowing latches 160 to move radially within aperture 166 on guide pin 168. An inner threaded counterbore 170 is provided in the lower end of body 150 for threadingly receiving a spline nut 172 having a plurality of internal splines 174 forming longitudinal slots therebetween. Internal splines 174 are spaced such that the longitudinal slots receive splines 122 on release nut 110, previously described.

Piston 152 includes an upper counterbore 176 adapted for receiving the reduced diameter lower end of body 150. A shear pin 178 extends between piston 152 and body 150. Piston 152 further includes an enlarged diameter portion 182 projecting radially outward. Enlarged diameter portion 182 includes a plurality of apertures or pockets 184 housing individual retractable setting dogs 180. Retractable setting dogs 180 each include a pair of arcuate flanges 185 which engage a retainer ring 186 extending around enlarged diameter portion 182 for maintaining retractable dogs 180 within pockets 184. Setting dogs 180 are spring biased radially outward by springs 188. Piston 152 further includes an enlarged inner diameter portion 191 which includes an inwardly projecting radial boss 192 housing a sealing member 194 which seals with lower mandrel 130 in its uppermost position best shown in FIG. 4B as hereinafter described. Enlarged inner diameter portion 191, boss 192 and the lower terminal end of body 150 form an annular cylinder or chamber 190 upon lower mandrel 130 being raised to its upper position shown in FIG. 4B. The lower terminal end 196 of piston 152 has a reduced outer diameter 197 for receiving a centralizer ring 201 which is maintained on reduced diameter portion 197 by a snap ring 198. Centralizer ring 201 contacts the inside diameter of tubular member 62 to centralize packer setting tool 60 within liner packer 40. Piston 152 is provided at its lower end with an inwardly facing annular channel 199 which houses a ratchet ring 200 with inner ratchet teeth 202 adapted to engage ratchet teeth 142 on sleeve 140.

Liner Hanger

Referring now to FIG. 2A, liner hanger 30 includes a tubular member 208 having a plurality of slips 210 mounted within slip slots 212 disposed around liner hanger 30. The upper end of slip slots 212 and the upper end of slips 210 have inclined camming surfaces at 214 for camming slips 210 radially outward and into engagement with outer casing 14. A threaded box 216 with left-hand internal threads is provided at the upper end of liner hanger 30 for receiving a running nut 220. Running nut 220 has outer left-hand threads which threadingly engage the inner left-hand threads of box 216. Nut 220 also includes a plurality of longitudinal apertures 219 for the passage of fluids. Running nut 220 includes a plurality of splined slots on its inside diameter for receiving splines 223 located on the lower end of kelly 228 at the upper end of pocket slip setting tool 50 as hereinafter described. Further details of the liner hanger 30 are disclosed in U.S. Pat. No. 4,712,614, and in U.S. patent application Ser. No. 08/782,485 filed on Jan. 14, 1997, concurrently herewith, and entitled "Liner Assembly and Method", Attorney File No. 1030-07501, both incorporated herein by reference.

Pocket Slip Setting Tool

The pocket slip setting tool 50 includes an inner tubular mandrel 222 which includes a threaded pin at its upper end for threaded engagement to the threaded box on the lower end of kelly 228. Kelly 228 is threadingly connected to the lower end of pipe string 22 shown in FIG. 1. A bearing housing 234 is received over kelly 228 and is attached thereto to form a junk cover for liner hanger 30. Housing 234 prevents deleterious material from falling into the upper end of liner hanger 30 and includes a plurality of ports 236 for the passage of fluids. The lower end of kelly 228 is in the form of a hex 232 having splines 223 which form slots for receiving the internal splines on running release nut 220. The lower end of kelly 228 includes upwardly facing stop shoulders 221 for abutting engagement with the lower end of running nut 220.

A unitary hydraulic-mechanical actuator assembly 240 is disposed around inner mandrel 222 below kelly 228. Actuator assembly 240 includes an actuator sleeve piston 224 slidably mounted on the exterior of inner mandrel 222. A dog housing 227 is threaded to the lower end of piston 224 and includes a plurality of dogs 230 projecting through apertures 231. A shear member 229 is threaded onto the lower end of housing 227. The piston 224 has an inwardly facing annular flange 225 forming a hydraulic cylinder chamber 235 with an annular boss 237 which projects radially outward from inner mandrel 222. Seals are provided on flange 225 and boss 237 for sealing chamber 235. Ports 238 provide fluid access from the flowbore 54 of mandrel 222 to the chamber 235. A stop ring 239 is provided on mandrel 222 within chamber 235 to compress a spring 219 between flange 225 and stop ring 239. The shear member 229 includes shear screws 242 threaded into inner mandrel 222. An inwardly directed annular channel 243 is provided in the lower end of shear member 229 for receiving a split latch ring 245 having internal ratchet teeth 241. A dog release groove 244 is disposed around mandrel 222 such that upon split ratchet ring 245 engaging a lower ratchet ring 246, mounted around the lower end of inner mandrel 222, annular release groove 244 is positioned beneath dogs 230. Further details of the hanger setting tool 50 are disclosed in U.S. Pat. No. 4,712,614, incorporated herein by reference.

Setting the Liner Hanger

Referring now to FIG. 1, the liner assembly 10 is lowered into the bore 56 formed by outer casing 14 and borehole 20.

As shown in FIG. 1, the top of liner assembly 10 is a distance A above the bottom of outer casing 14. The lower end of liner 26 is a distance B above the borehole bottom 24. Distance A, typically in the range of 200 to 500 feet, is greater than distance B.

Referring now to FIGS. 1 and 2A–C, in the operation of the hanger setting tool 50, the hanger slips 210 can be set either mechanically or hydraulically. For hydraulic setting, the liner 26, liner hanger 30, setting tool 50, and pipe string 22 are lowered and located in the borehole 20 and casing 14 at a depth where the liner hanger 30 is to be set. The sealing ball or plug 35 is dropped through the pipe string 22 to ball catcher 52 which is releasably mounted in landing collar 32. At that time, the borehole of setting tools 50, 60, liner 26 and borehole 54 are sealed to prevent any further downward fluid movement. By pressuring up on the fluid in the pipe string 22, pressure in the annular chamber 235 first shears shear screws 242 and then the hydraulic force on the piston 224 (as well as the spring force), moves piston 224 upwardly on inner mandrel 222 causing the dogs 230 to move upwardly while engaging the lower end 211 of slips 210. The shear pin 215 for slips 210 is sheared and the slips 210 are moved outwardly along the inclined surfaces 214 causing slips 210 to engage well casing 14 for supporting the weight of liner 26. The pipe string 22 is then lowered and, upon right hand rotation of the pipe string 22, the running nut 220 unthreads from the box 216 due to their left-hand threads. At the same time, piston 224 unscrews from dog housing 227 so that inner mandrel 222 can be disengaged from liner hanger 30. Upon moving the pipe string 22 upwardly, the ratchet ring 246 on the lower end of inner mandrel 222 is received by and engages the split ratchet ring 245. Further, the release groove 244 is located beneath the dogs 230 so that the dogs 230 are moved inwardly and released from slips 210. The entire setting tool assembly 50, 60 is then lifted off liner hanger 30.

Alternatively, to set the liner hanger 30 mechanically, liner 26 is lowered in the well until it engages the bottom 24 of the well bore 20 to ensure that the piston 224 can be rotated relative to the liner hanger 30. By rotating the pipe string 22, shear pin 242 is sheared and spring 219 moves the piston 224 upwardly. The spring force of the spring 219 causes the dogs 230 to engage the lower end 211 of slips 210 and shears shear pins 215 and releases slips 210. Upon lifting the pipe string 22, the stop flange 221 below the running nut 220 contracts the nut 220. The pipe string 22 then is raised to move liner 26 to the desired location from well bottom 24 while slips 210 drag along the well bore surface and are being pushed outwardly by the spring force only. At the desired location for hanging liner 26, the pipe string 22 is lowered thus setting the slips 210 and hanging the liner 26 in outer casing 14. Next, the pipe string 22 is slacked-off so that load is removed from nut 220 to allow rotation of pipe string 22 to release the nut 220 and the hanger setting tool 50 from the liner hanger 30. At this time, inner mandrel 222 is raised so that the ratchet ring 246 is received by and engages split ratchet ring 245 and release groove 244 is aligned with and releases dogs 230 from slips 210.

The Cementing Operation

Referring again to FIGS. 1, 2A–C, and 5, to begin the cementing operation, the flowbore 54 is opened by pressuring down flowbore 54 (formed by pipe string 22 and setting tools 50, 60) to shear ball catch 52 from landing collar 32 and release the ball catch 52 with sealing plug 35. This allows fluid flow around the lower end of liner 26 and up the annulus 56 formed between liner 26 and borehole 20 and between pipe string 22 and outer casing 14. Cement is then pumped down flowbore 54 through the one-way valve in flow collar 34 and the one way valve in shoe 36 and around the lower end of liner 26. The cement then flows up the annulus 56 adjacent borehole 20. As the cement approaches the liner hanger 30, a solid nose plug (not shown) with wipers is pumped down on top of the cement column and latches with wiper plug 44. The wipers on the plug wipe the cement from the inside diameter of pipe string 22. The wiper plug 44 is then run through the liner 26 wiping the cement off the inside diameter of liner 26. This provides for a smooth clean inside diameter.

As the cement flows up that portion of the annulus 56 between liner 26 and borehole 20, the cement reaches the liner packer 40. The liner packer 40 has not yet been set. The cement is allowed to not only pass through that portion of the annulus 56 between the liner packer 40 and outer casing 14 but also through cement by-pass ports 80, as shown by arrows in FIG. 5, and up the annular area 81 between packer setting assembly 100 and tubular member 62. Annular area 81 also extends between the pocket slip setting tool 50 and liner hanger 30. When wiper plug 44 lands and latches into landing collar 32, the cementing operation is complete. Running nut 220, best shown in FIG. 2A, includes ports 219 which also allow the cement, if necessary, to pass through junk cover 234 and out ports 236 and back into that portion of the annulus 56 between pipe string 22 and outer casing 14. Allowing the cement to flow through by-pass ports 80 and up annular area 81 inside liner packer 40 as well as up annulus 56 around liner packer 40 avoids any restriction to cement flow, as distinguished from the prior art.

Setting the Liner Packer

As soon as the cementing operation is completed, the liner packer 40 is set by the packer setting tool 60. FIGS. 2A–C and 4A illustrate the positioning of the packer setting tool 60 with respect to the liner packer 40 upon completing the cementing operation.

Figure 4A:
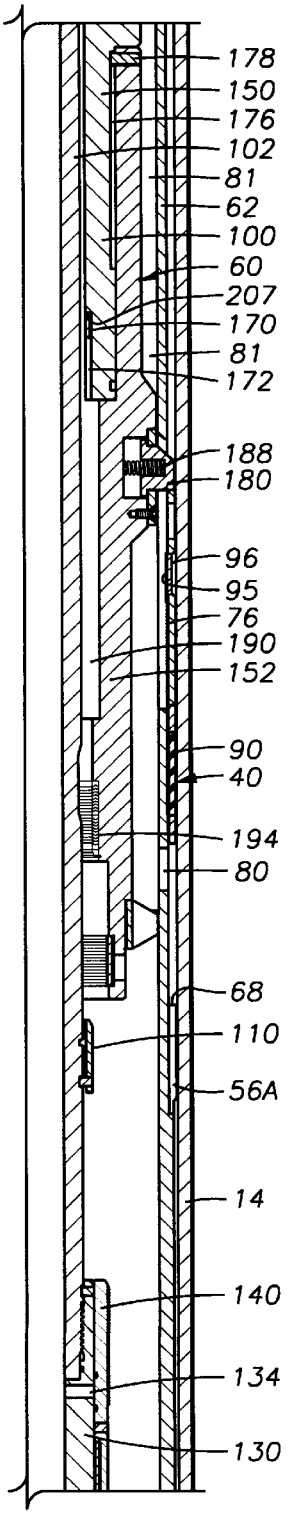
FIG. 4A is a partial cross-sectional elevation view of the liner packer and packer setting tool in the running position.
Figure 4B:
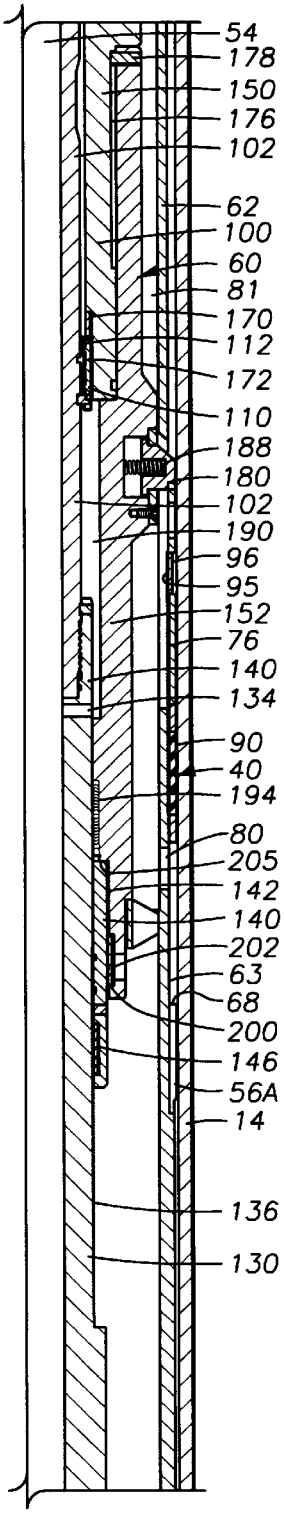
FIG. 4B is a partial cross-sectional elevation view of the liner packer with the mandrel of the packer setting tool in engagement with the packer actuator assembly.

Referring now to FIG. 4B, the lower mandrel 130 of packer setting tool 60 is raised by pipe string 22. As sleeve 140 is received within the lower end of liner packer assembly 100, the upper terminal end of sleeve 140 engages downwardly facing shoulder 205 causing sleeve 140 to become stationary and move downwardly on lower mandrel 130 as the upward movement of sleeve 140 is halted by shoulder 205 and lower mandrel 130 continues its upward movement. In this lower position, lower ratchet ring 146 engages the external ratchet threads 136 on the exterior of lower mandrel 130. Simultaneously, sleeve 140 is received by upper ratchet ring 200 causing ratchet teeth 202 to engage ratchet threads 142 on sleeve 140. Also, the spline nut 172 on liner packer assembly 100 receives and abuts release nut 110 on mandrel 130. The beveled noses 124, 126 (See FIG. 3) on the splines 122 of release nut 110 guide splines 122 into the spline slots formed between the splines of spline nut 172.

Figure 4C:
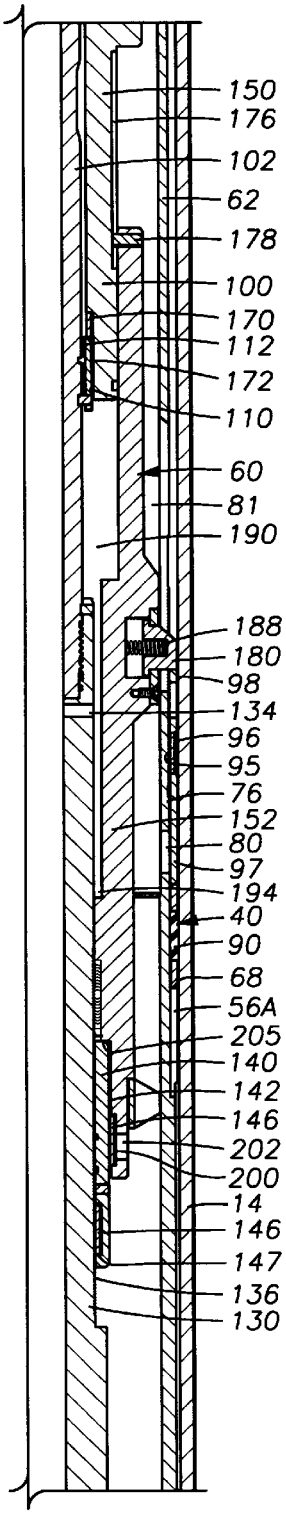
FIG. 4C is a partial cross-sectional elevation view of the liner packer which has been set hydraulically.

Referring now to FIG. 4C, the liner packer 40 may be set either mechanically or hydraulically or hydraulically and mechanically. To set the liner packer 40 hydraulically, the packer setting tool 60 is raised to its uppermost position as shown in FIG. 4B. In this uppermost position, hydraulic chamber 190 is formed by the sealing engagement of sealing member 194 with lower mandrel 130. Previously, as shown in FIG. 4A, chamber 190 is open. Further, hydraulic ports 134 register with hydraulic chamber 190. Upon applying hydraulic pressure down the flowbore 54 of pipe string 22, hydraulic pressure is applied to piston 152 causing piston 152 to move downwardly within the cylinder 190 with respect to mandrel 102 and liner packer 40. The retractable setting dogs 180 bear against the upper annular terminal end of spacer and retainer ring 98 shifting ratchet ring 96, spacer ring 99, and packer element 90 downward over the reduced diameter portion 63 of tubular member 62 until the lower terminal end of packing element 90 engages upwardly facing annular shoulder 68. The packing element 90 completely passes over by-pass ports 80. Packing element 90 is then compressed and radially energized into sealing engagement with the inside diameter of outer casing 14. Further, the teeth 95 on ratchet ring 96 engage the teeth 76 around reduced diameter portion 63 so as to maintain packing element 90 in the energized position shown in FIG. 4C.

Figure 4D:
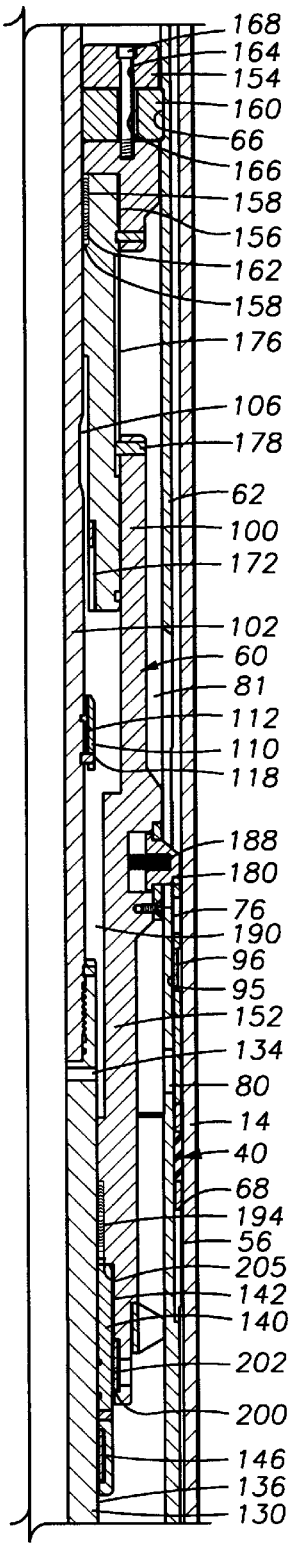
FIG. 4D is a partial cross-sectional elevation view of the liner packer and packer setting tool with the packer set mechanically.

Alternatively, the liner packer 40 may be set mechanically as shown in FIG. 4D. Since the lower ratchet ring 146 has engaged ratchet threads 136 and the outer ratchet threads 142 on sleeve 140 have engaged ratchet threads 202 on ratchet ring 200, weight may be placed on the pipe string 22 causing the respective ratchet threads to transmit the load from the inner mandrel 102 to the packer setting assembly 100. Thus, the weight is transferred to retractable setting dogs 180 by means of piston 152 setting liner packer 40 in the sequence previously described.

Further, it should be appreciated that the liner packer 40 may be set hydraulically and mechanically. The liner packer 40 may be set hydraulically as previously described with respect to FIG. 4C and then further set mechanically as described with respect to FIG. 4D by placing weight on the pipe string 22 which is transferred to retractable setting dogs 180 to further compress and energize packing elements 90 on liner packer 40 into engagement with outer casing 14.

Figure 4E:
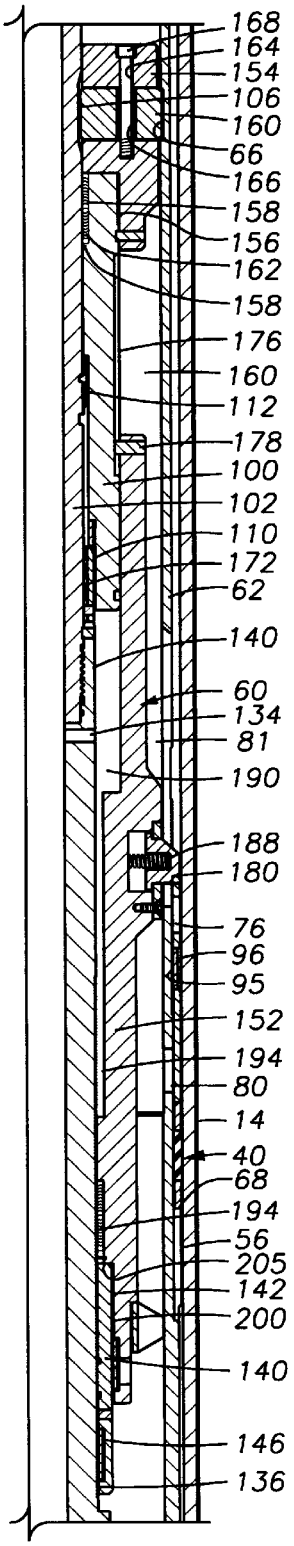
FIG. 4E is a partial cross-sectional elevation view of the packer setting tool in the release position.

Referring now to FIG. 4E, to release packer setting tool 60, pipe string 22 is rotated. During the rotation, the light shear screw 118 keeps shear release ring 112 rotating with mandrel 102 thereby causing it to rotate from underneath spline release nut 110. Thus, upon rotation, the spline release nut 110 is rotated off the threaded split ring 112. Upon pickup of inner mandrel 102, retractable setting dogs 180 are biased inwardly against springs 188. Upon raising inner mandrel 102, annular groove 106 is positioned beneath latches 160 allowing them to be cammed inwardly upon further upward movement of mandrel 102.

Figure 4F:
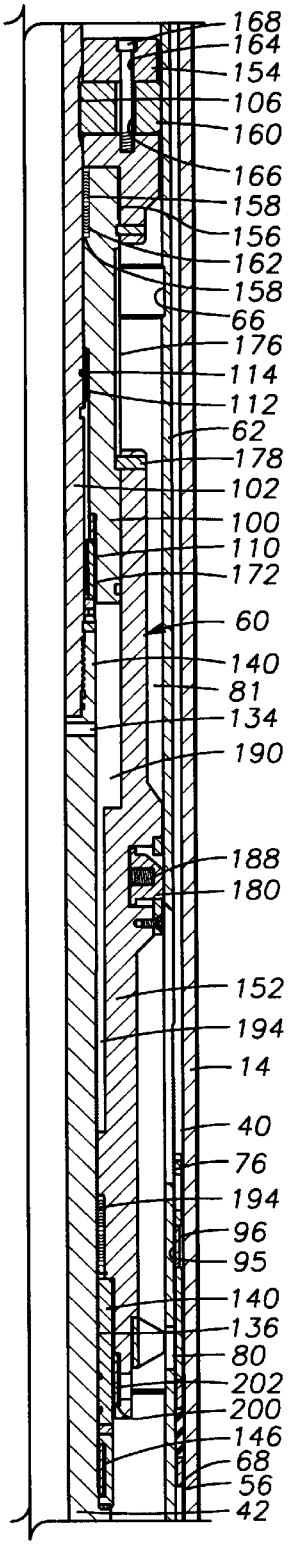
FIG. 4F is a partial cross-sectional elevation view of the packer and packer setting tool with the packer setting tool in the retrieving position.
Figure 5:
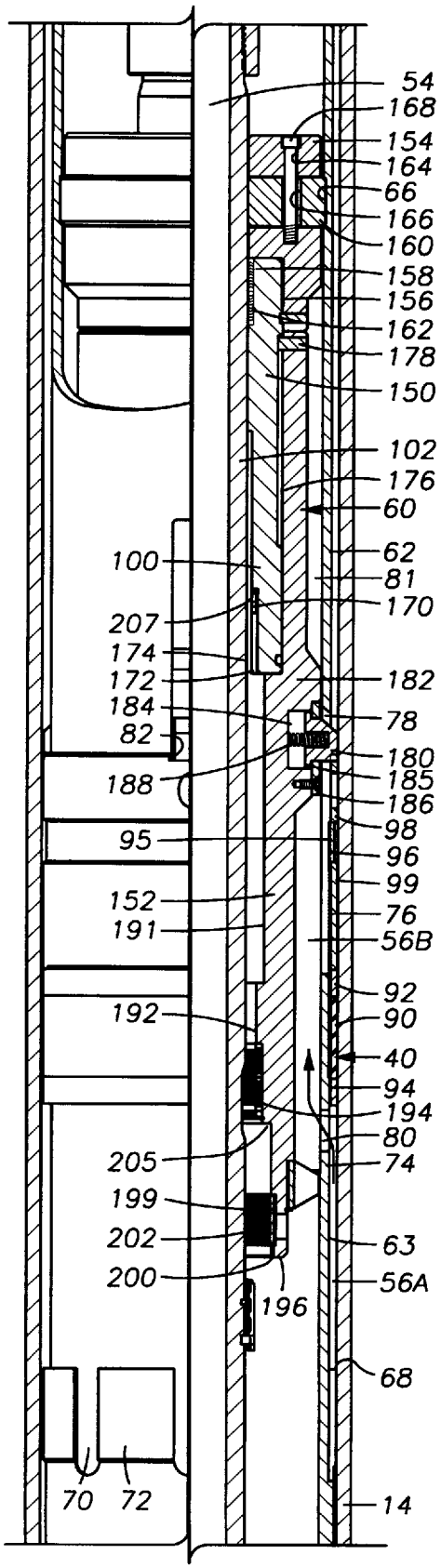
FIG. 5 is an enlarged cross-sectional elevation view of the liner packer shown in FIG. 2B.

The packer setting tool 60 may then be retrieved from the hole as shown in FIG. 4F.

The packer setting tool 60 further includes an emergency shear release. The inwardly directed flange member 114 on threaded split ring 112 located in groove 116 of mandrel 102 acts as a shear ring. Upward movement of mandrel 102 shears flange member 114 allowing annular groove 106 to be positioned beneath latches 160. The threaded split ring 112 in the lower end 102 of packer setting tool 60 is also a shear ring. The flange 114 on the threaded split ring 112 may be sheared allowing everything to be removed from the well.

While a preferred embodiment of the invention has been shown and described, modifications thereof can be made by one skilled in the art without departing from the spirit of the invention.

What is claimed:

1. A packer for sealing with an outer casing to prevent the flow of wellbore fluids, comprising:

a tubular body having a tubular wall with an aperture through the wall;

a packing element movably disposed on said tubular body between an open position allowing wellbore fluids to flow through said aperture and a closed position preventing wellbore fluids from flowing through said aperture.

2. The packer of claim 1 wherein in said open position said packing element is on one side of said aperture and in said closed position said packing element is moved to the other side of said aperture on said tubular wall.

3. The packer of claim 1 further including a locking member mounted on said tubular body for maintaining said packing element in said closed position.

4. The packer of claim 3 wherein said locking member engages said tubular body to maintain said packing element in said closed position.

5. The packer of claim 4 wherein said locking member and said tubular body have interengaging ratchet teeth which allow said locking member to move said packing element from said open position to said closed position but not move from said closed position to said open position.

6. The packer of claim 1 further including an actuator member mounted on said tubular member for moving said packing element to said closed position and compressing said packing element into sealing engagement with the outer casing.

7. The packer of claim 6 further including a locking member on said tubular body to maintain said packing element in said sealing engagement.

8. The packer of claim 1 further including a stop member on said tubular body disposed a distance below said aperture for engaging said packing element in said closed position.

9. The packer of claim 8 further including an actuator member mounted on said tubular member for compressing said packing element against said stop member and into sealing engagement with the outer casing.

10. The packer of claim 8 wherein said distance is greater than the length of said packing element.

11. The packer of claim 8 wherein said stop member includes fluted passageways for the passage of wellbore fluids.

12. A packer for being disposed between an inner member and an outer casing to form an inner annular area and an outer annular area for the flow of wellbore fluids, comprising:

a tubular body having a tubular wall with an aperture through the wall;

a packing element movably disposed on said tubular body between an open position allowing wellbore fluids to flow through said aperture and a closed position preventing wellbore fluids from flowing through said aperture; and said tubular body and packing element being sized to allow the sum of the inner and outer annular areas to approximate the annular flow area of the wellbore fluids below said tubular body.

13. A packer for packing off the annulus formed with an outer casing to the flow of wellbore fluids, comprising:

a tubular mandrel having a tubular wall with at least one aperture therethrough for the flow of the wellbore fluids;

a stop member disposed on one side of said aperture;

a packing element disposed in a first position on another side of said aperture; and an actuator member for moving said packing element to a second position from said another side to said one side of said aperture position and causing said packing element to engage said stop member to compress said packing element into sealing engagement with said outer casing.

14. The packer of claim 13 wherein said packing element moves over said aperture in moving from said first position to said second position.

15. The packer of claim 13 wherein said aperture opens the interior of said tubular member to the flow of the wellbore fluids.

16. A method of cementing a well comprising the steps of:

disposing a packer between an inner tubular member and an outer casing within the well;

flowing wellbore fluids down the flowbore of the inner tubular member;

flowing wellbore fluids up the annulus formed by the inner tubular member and the outer casing;

flowing wellbore fluids through an outer annular area formed between the packer and the outer casing;

flowing wellbore fluids through an aperture in the packer; and flowing wellbore fluids through an inner annular area formed between the inner tubular member and the packer.

17. The method of claim 16 wherein the inner and outer annular areas approximate the flow area of the annulus formed by the inner tubular member and the outer casing below the packer.

18. The method of claim 16 wherein the flow of the wellbore fluids past the packer is not restricted by the packer.

19. The method of claim 16 further including the steps of compressing a packing element on the packer to close the aperture and sealingly engaging the outer casing with the packing element.

* * * * *